US006363916B2

(12) United States Patent
Kawakami et al.

(10) Patent No.: US 6,363,916 B2
(45) Date of Patent: Apr. 2, 2002

(54) FUEL INJECTION CONTROL DEVICE

(75) Inventors: Takeshi Kawakami; Koichi Yamane; Shoso Tsunekazu, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/754,213

(22) Filed: Jan. 5, 2001

(30) Foreign Application Priority Data

Jun. 12, 2000 (JP) ..... 2000-175082

(51) Int. Cl.[7] ..... F02M 51/00
(52) U.S. Cl. ..... 123/491
(58) Field of Search ..... 123/491, 678, 123/685, 686

(56) References Cited

U.S. PATENT DOCUMENTS

| | | | | | |
|---|---|---|---|---|---|
| 4,404,944 | A | * | 9/1983 | Yamazaki et al. | 123/458 |
| 4,635,606 | A | * | 1/1987 | Koike et al. | 123/463 |
| 4,671,240 | A | * | 6/1987 | Tanaka et al. | 123/463 |
| 5,394,857 | A | * | 3/1995 | Yamakawa | 123/491 |
| 5,564,404 | A | * | 10/1996 | Takahashi et al. | 123/491 |
| 5,586,539 | A | * | 12/1996 | Yonekawa et al. | 123/458 |
| 5,797,369 | A | * | 8/1998 | Suzuki et al. | 123/491 |

FOREIGN PATENT DOCUMENTS

| | | |
|---|---|---|
| JP | 59-32627 | 2/1984 |
| JP | 2-4784 | 1/1990 |
| JP | 2893997 | 3/1999 |

* cited by examiner

*Primary Examiner*—Erick Solis

(57) ABSTRACT

The invention provides a fuel injection control device in which the cost is low and the fuel injection quantity is flexibly adjusted corresponding to the operating conditions.

The fuel injection control comprises: a water temperature detector for detecting a cooling water temperature of an internal combustion engine; an intake temperature detector for detecting an intake air temperature of the internal combustion engine; a pressure detector for detecting an intake air pressure of the internal combustion engine; a calculator means for calculating a driving time period for the fuel injection valve depending on a calculated value obtained from at least the cooling water temperature, the intake air temperature, and the intake air pressure; and a multiplier means for increasing the driving time by multiplying the calculated value by a correction coefficient at a high temperature engine starting condition established corresponding to the cooling water temperature, the intake air temperature, and the progress time; in which the high temperature engine starting condition is established in the condition that the cooling water temperature and the intake air temperature are higher than predetermined value, and the progress time is shorter than the predetermined value.

2 Claims, 6 Drawing Sheets

FUEL INJECTION CONTROL DEVICE

BACKGROUND OF THE INVENTION

1. Technical Field

The present invention relates to a fuel injection control device for internal combustion engine and, more particularly, to an improvement in starting characteristic for starting the engine at a high temperature.

2. Background Art

FIG. 4 is a schematic view showing a fuel injection control device according to a prior art. In the drawing, reference numeral 1 is an engine, and numeral 3 is a fuel injection valve for injecting a fuel to the engine 1 and disposed on a pipe wall of an intake pipe 2. Injection quantity from the fuel injection valve 3 is arranged to be in proportion to the fuel injection time period. For that purpose, a pressure regulator 4 is disposed so that pressure difference between fuel pressure of the fuel injection valve 3 and pressure of the intake pipe (intake air pressure) may be set to a predetermined value. A fuel chamber of the pressure regulator 4 is communicated to a delivery pipe 5 from a fuel tank (not illustrated), and the pressure regulator 4 circulates the fuel to the fuel tank through a return pipe 6. A back pressure chamber is connected to a fuel pressure switching solenoid 8 through a pipe 7.

FIG. 5 is a diagram showing a relation between driving time t of the engine 1 and respective pressures (fuel pressures A, B, atmospheric pressure Pa, intake air pressure Pb). Under normal driving condition, the pressure regulator 4 uses the intake air pressure as a reference pressure of the back pressure chamber. Fuel pressure is adjusted to a value higher than the intake air pressure by a predetermined pressure P0. Accordingly, as shown in FIG. 5, when the intake air pressure Pb drops sharply at the time tst of starting the engine 1, the pressure regulator 4 starts its operation. As the result, the fuel is returned to the fuel tank through the return pipe 6, and the fuel pressure B in the delivery pipe 5 also drops sharply. Moreover, when starting the engine 1 under a high engine temperature including restart of the engine at a high temperature after a high speed driving, there is a possibility that vapors (air bubble) are generated in the delivery pipe 5, air fuel ratio is lean, and the start becomes difficult.

To overcome this difficulty, when it is detected that the engine 1 is under the condition of high temperature at the time of starting the engine 1, the reference pressure of the pressure regulator 4 is changed over from the intake air pressure Pb to the atmospheric pressure Pa by means of the fuel pressure switching solenoid 8, whereby the fuel pressure becomes higher than the atmospheric pressure Pa by the predetermined pressure P0. Thus, the fuel pressure is improved. As a result, the fuel deficiency due to the generation of the vapors is corrected by changing the fuel pressure in the delivery pipe 5 from the condition B to condition A, i.e., increasing the fuel pressure by ΔP. In this manner, an appropriate quantity of fuel can be supplied to the fuel injection valve.

The fuel pressure switching solenoid 8 is connected to the intake pipe 2 through the pipe 7 and is open to the atmospheric air. When the fuel pressure switching solenoid 8 is off, the negative pressure Pb of the intake pipe 2 is applied to the back pressure chamber of the pressure regulator 4. On the other hand, when the fuel pressure switching solenoid 8 is on, the atmospheric pressure Pa is applied to the back pressure chamber of the pressure regulator. The on/off control of the fuel pressure switching solenoid 8 is performed by an ECU 12 on the basis of values measured by a water temperature sensor 9, an intake pipe pressure sensor 10 and an intake temperature sensor 11.

FIG. 6 is a flow chart showing the control by the ECU 12 of the conventional fuel injection control device. First, a water temperature WT is measured by the water temperature sensor 9, an intake air temperature AT is measured by the intake temperature sensor 11, and an intake air pressure Pb is measured by the intake pipe pressure sensor 10 (Step S101). Next, whether or not the engine 1 is in the mode representing a starting condition is judged (Step S102). When it is judged that the engine 1 is in the starting mode, the water temperature WT and the intake air temperature AT measured in the step S101 are renewed and stored as a starting water temperature WTst and a starting intake air temperature ATst, respectively (Step S103). When it is judged that the engine 1 is not in the starting mode, the operation advances to Step S104.

In Step S104, whether or not the water temperature WTst is higher than a predetermined value is judged. When it is judged that the water temperature WTst is higher than the predetermined value, then whether or not the intake air temperature ATst is higher than a predetermined value is judged (Step S105). When it is judged that the intake air temperature ATst is higher than the predetermined value, then whether or not the engine 1 is restarted within a predetermined time after the previous start is judged (Step S106). When it is judged that the engine 1 is restarted within the predetermined time, the fuel pressure switching solenoid 8 is turned on, and the atmospheric pressure Pa is introduced into the pressure regulator 4 (Step S107). On the other hand, when it is judged that the temperature WTst or ATst is lower than the predetermined value and the engine is restarted without the predetermined time in Steps S104 to S106, the fuel pressure switching solenoid 8 is turned off and the negative pressure Pb in the intake pipe is introduced into the pressure regulator 4 (Step S108).

As described above, after turning on/off the fuel pressure switching solenoid 8, a driving time period of the fuel injection valve 3 is calculated (Step S109). The driving time period Tinj is obtained from the following expression:

$$Tinj = Kinj \times Pb \times Ketc$$

where: Pb is the intake air pressure measured in Step S101, and Kinj is a coefficient for converting the intake air pressure Pb into the driving time period of the fuel injection valve 3.

The intake air pressure Pb is substantially in proportion to the intake air flow of the cylinder. Therefore, when the pressure difference between the intake air pressure acting on the fuel injection valve 3 and the fuel pressure is constant, the fuel injection quantity from the fuel injection valve 3 is in proportion to the driving time period thereof, and becomes a substantially constant ratio with respect to the intake air flow of the cylinder of the engine.

Ketc is a coefficient corresponding to various conditions. Representatives of such coefficient are intake air temperature correction coefficient corresponding to change in mass of the intake air due to change in intake air temperature, warming up correction coefficient for increasing the fuel injection quantity corresponding to the water temperature in order to accelerate warming up when the engine is started at a low temperature, feedback correction coefficient for increasing or decreasing the fuel injection quantity on the basis of oxygen information of the exhaust pipe in order to keep the air-fuel ratio at an appropriate value, and soon. Furthermore,correction coefficient for increasing the fuel quantity at the time of acceleration, correction coefficient for decreasing the fuel quantity at the time of deceleration and so on may be added, if necessary.

As a result, in the step S109, a calculated value according the driving time period Ting is calculated from at least the cooling water temperature, the intake air temperature, and intake air pressure.

As described above, in a predetermined time after starting at a high temperature, the fuel pressure acting on the fuel injection valve is increased. Therefore, reduction in fuel due to vapor, etc. is corrected in increasing tendency, whereby starting performance of the engine and stability in idling after starting are both improved.

However, in the conventional fuel injection control device of above construction and function, it is essential to include the fuel pressure switching solenoid 8 for switching the reference pressure regulated by the pressure regulator 4 from intake air pressure to atmospheric pressure. This results in a problem of increasing the cost.

Moreover, in the fuel pressure switching solenoid 8, the fuel pressure is increased by ΔP corresponding to the pressure difference between the atmospheric pressure Pa and the intake air pressure Pb. Depending on the operating conditions, however, more or less fuel quantity than the pressure difference is actually increased in some cases. This results in a further problem of making it impossible to flexibly adjust the fuel quantity corresponding to the operating conditions.

SUMMARY OF THE INVENTION

The present invention was made to solve the above-discussed problems, and has an object of providing a fuel injection control device in which cost is low and fuel injection quantity is flexibly adjusted corresponding to the operating conditions.

A fuel injection control device according to the invention comprises:

- a fuel injection valve for supplying a fuel into an intake pipe of an internal combustion engine,
- a water temperature detector for detecting a cooling water temperature of the internal combustion engine,
- an intake temperature detector for detecting an intake air temperature of the internal combustion engine,
- a pressure detector for detecting an intake air pressure of the internal combustion engine,
- means for deciding a driving time period for said fuel injection valve depending on a calculated value calculated from at least the cooling water temperature, the intake air temperature, and the intake air pressure, and
- means for increasing the driving time period by multiplying the calculated value by a correction coefficient at a high temperature engine starting condition established corresponding to the cooling water temperature, the intake air temperature, and a progress time after starting time of the internal combustion engine,
- wherein the high temperature engine starting condition is established on the condition that the cooling water temperature and the intake air temperature are higher than predetermined value, and the progress time is shorter than the predetermined value.

As a result of this, an advantage is achieved such that it is now possible to supply a deficient fuel quantity due to generation of vapor at the starting condition under starting engine at a high temperature, without any fuel pressure switching solenoid and, thus cost of the fuel injection control device is substantially reduced. Further, it is possible to flexibly establish the fuel injection quantity taking into consideration characteristics of individual engines and driving conditions thereof.

DESCRIPTION OF THE PREFERRED EMBODIMENTS

Figure 1:
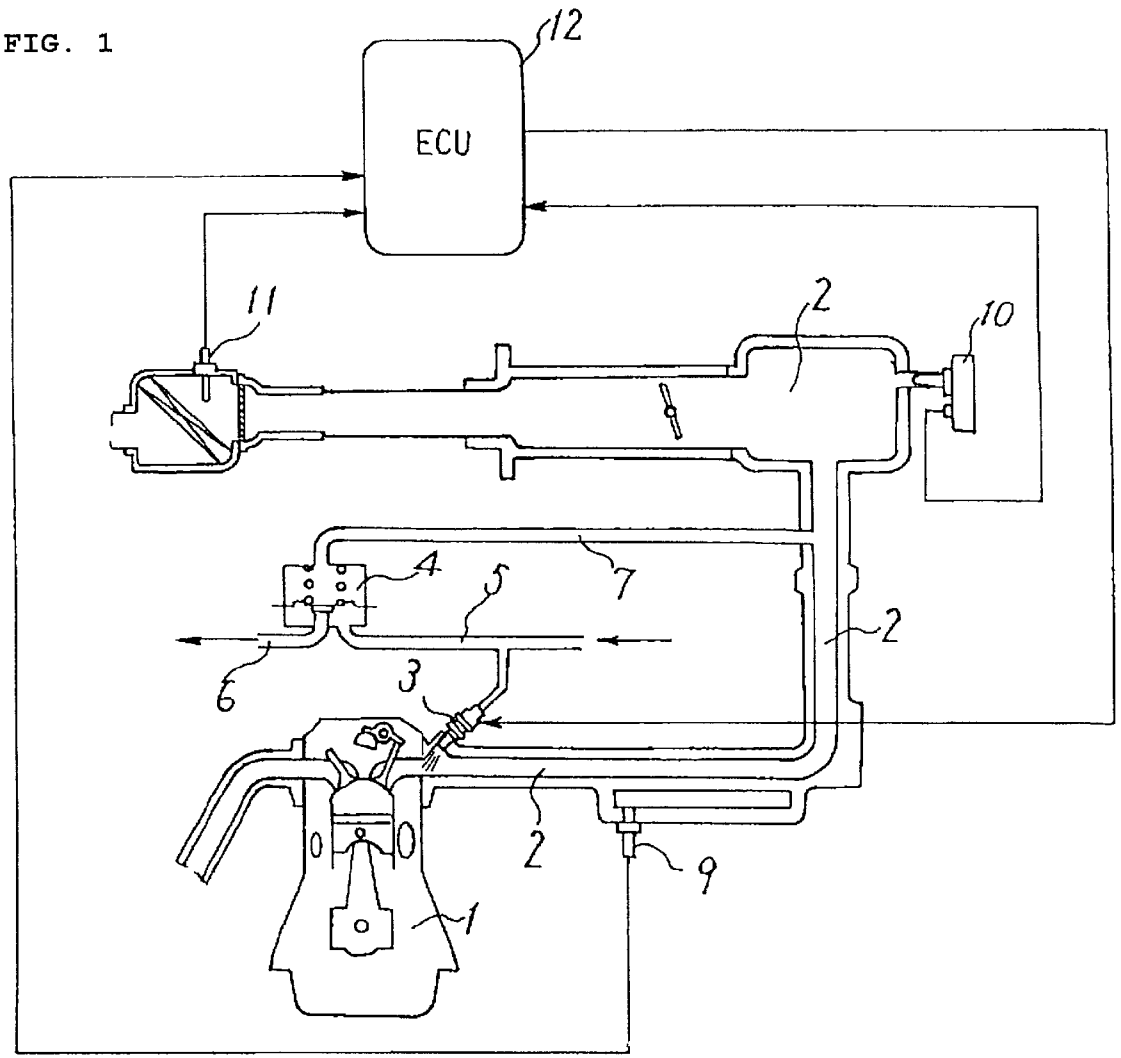
FIG. 1 is a schematic view showing a fuel injection control device according to an embodiment of the present invention.

FIG. 1 is a schematic view showing a fuel injection control device according to an embodiment of the present invention. In the drawing, reference numeral 1 is an internal combustion engine, and numeral 3 is a fuel injection valve for injecting a fuel to the engine 1 and disposed on a pipe wall of an intake pipe 2. Injection quantity from the fuel injection valve 3 is arranged to be in proportion to the fuel injection time period. For that purpose, a pressure regulator 4 is disposed so that pressure difference between fuel pressure of the fuel injection valve 3 and pressure of the intake pipe 2 (hereinafter referred to as intake air pressure) may be set to a predetermined value. A fuel chamber of the pressure regulator 4 is communicated to a delivery pipe 5 from a fuel tank (not illustrated), and the pressure regulator 4 circulates the fuel to the fuel tank through a return pipe 6.

In the mentioned prior art, the reference pressure of the pressure regulator 4 is changed over from the intake air pressure Pb to the atmospheric pressure Pa by the fuel pressure switching solenoid 8, whereby the fuel pressure is increased by ΔP to increase fuel supply quantity and, finally, fuel deficiency due to the generation of the vapors is corrected. On the other hand, in the invention, when cooling water temperature and intake air temperature are high at the time of starting the engine, a control is applied so that a driving time period of the fuel injection valve 3 is longer than that under normal driving time period, using a predetermined correction coefficient instead of the fuel pressure switching solenoid 8. The control is performed by the ECU 12 on the basis of values measured by a water temperature sensor 9, an intake pipe pressure sensor 10, and an intake air temperature sensor 11.

Figure 2:
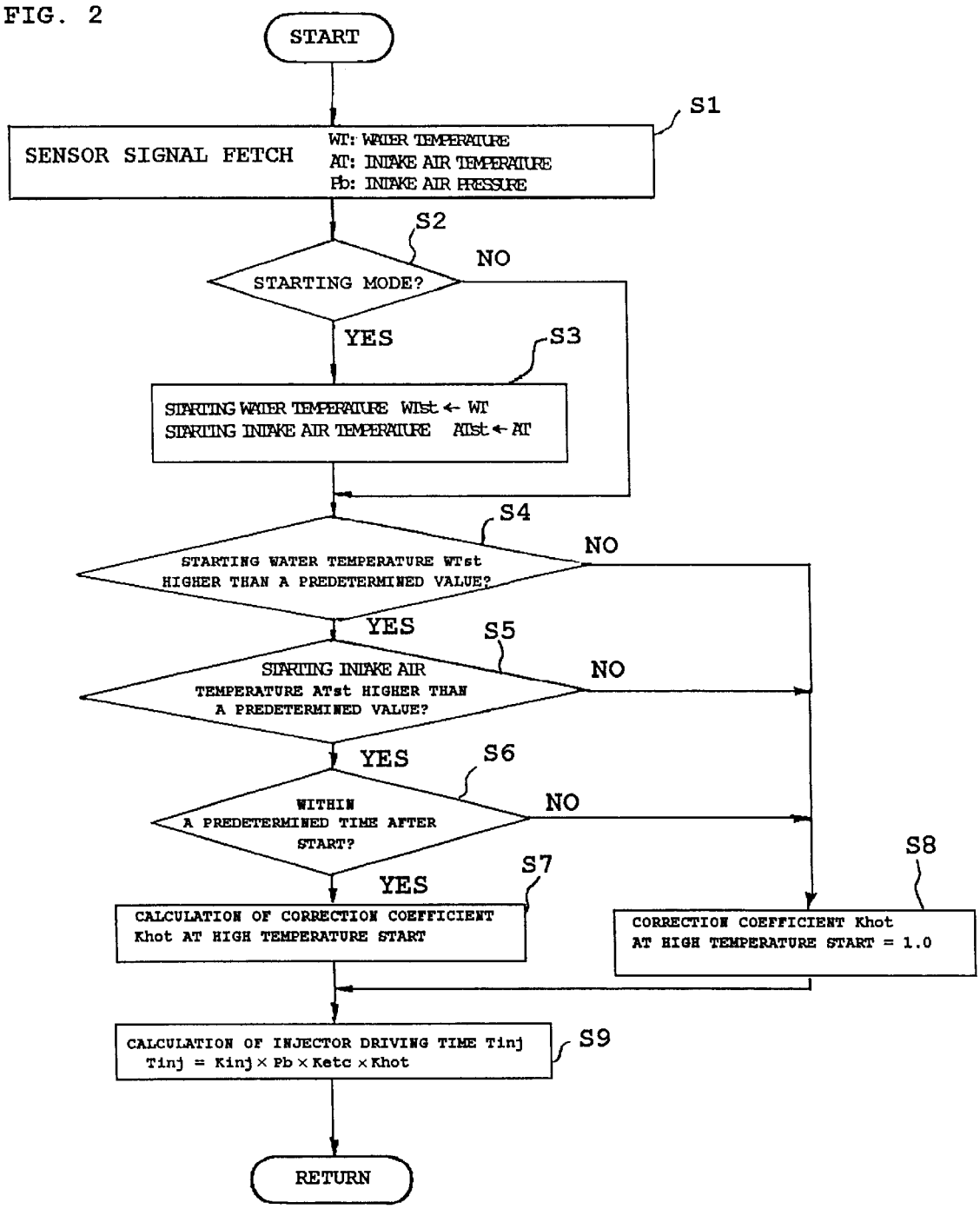
FIG. 2 is a flow chart showing a control method in an ECU of the fuel injection control device according to the embodiment of the invention.

FIG. 2 is a flow chart showing a control method in the ECU 12 of the fuel injection control device according to the embodiment of the invention. First, a water temperature WT is measured by the water temperature sensor 9, an intake air pressure Pb is measured by the intake pipe pressure sensor 10 and an intake air temperature AT is measured by the intake temperature sensor 11 (Step S1). Next, whether or not the engine 1 is in starting mode is judged (Step S2). When it is judged that the engine 1 is in starting mode, a starting water temperature WTst is measured by the water temperature sensor 9 and a starting intake air temperature ATst is measured by the intake temperature sensor 11, and they are respectively indicated by WT and AT (Step S3). When it is judged that the engine 1 is not in starting mode, the control process goes to Step S4.

Next, whether or not the water temperature WTst is higher than a predetermined value is judged (Step S4). When it is judged that the water temperature WTst is higher than a predetermined value, then whether or not the intake air temperature ATst is higher than a predetermined value is judged (Step S5). When it is judged that the intake air temperature ATst is higher than a predetermined value, then whether or not the engine 1 is restarted within a predetermined time period after the previous start is judged (Step S6). In other word, at the Step S6, a progress time after starting time of the engine is checked, and compared the progress time within a predetermined time period. When it is judged that the engine 1 is restarted within a predetermined time period, the engine 1 is in high temperature condition at the time of starting, and therefore a correction coefficient Khot for starting at a high temperature is calculated.

Figure 3:
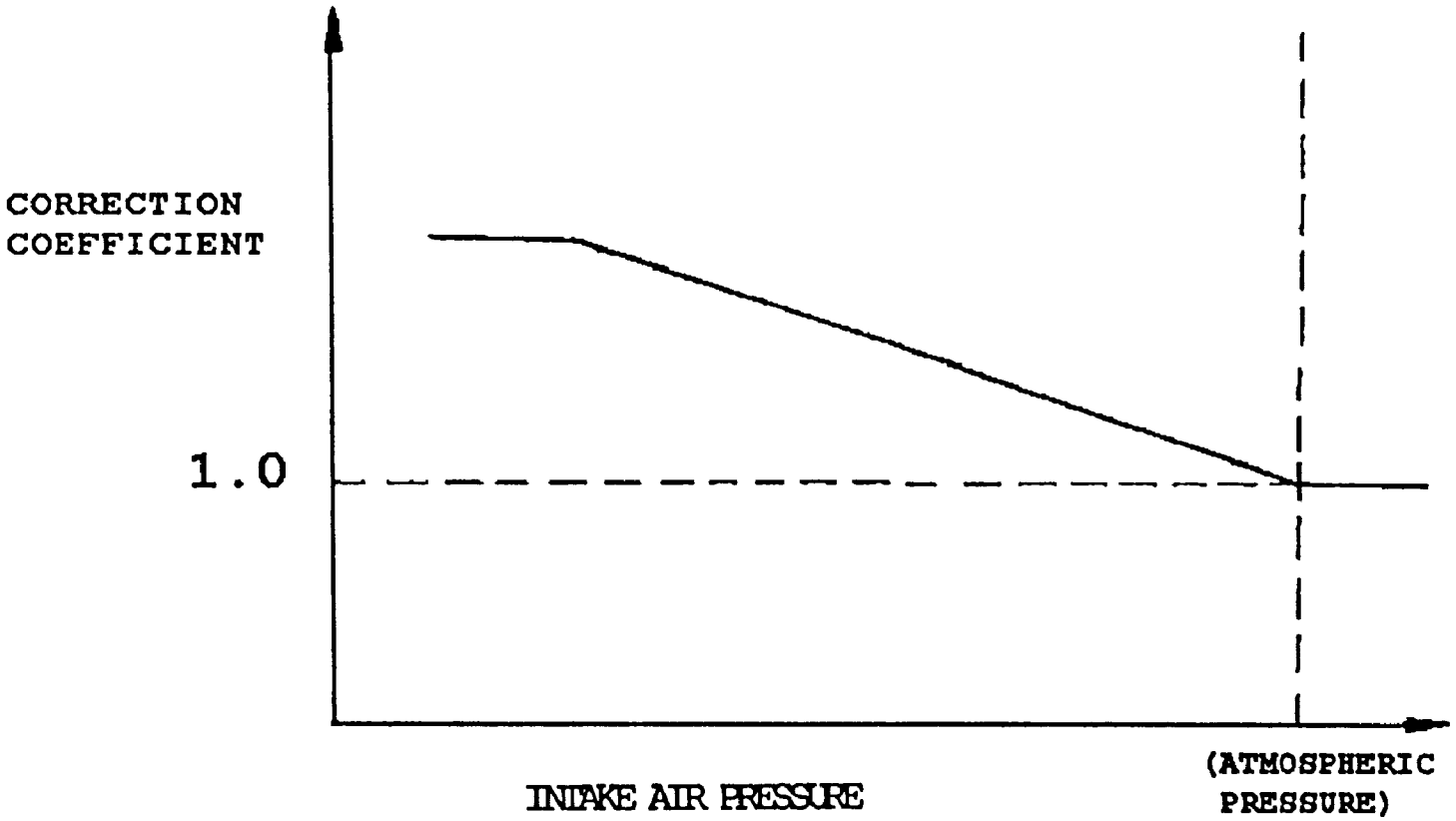
FIG. 3 is a graph to explain a correction coefficient used in the fuel injection control device according to the embodiment of the invention.
Figure 4:
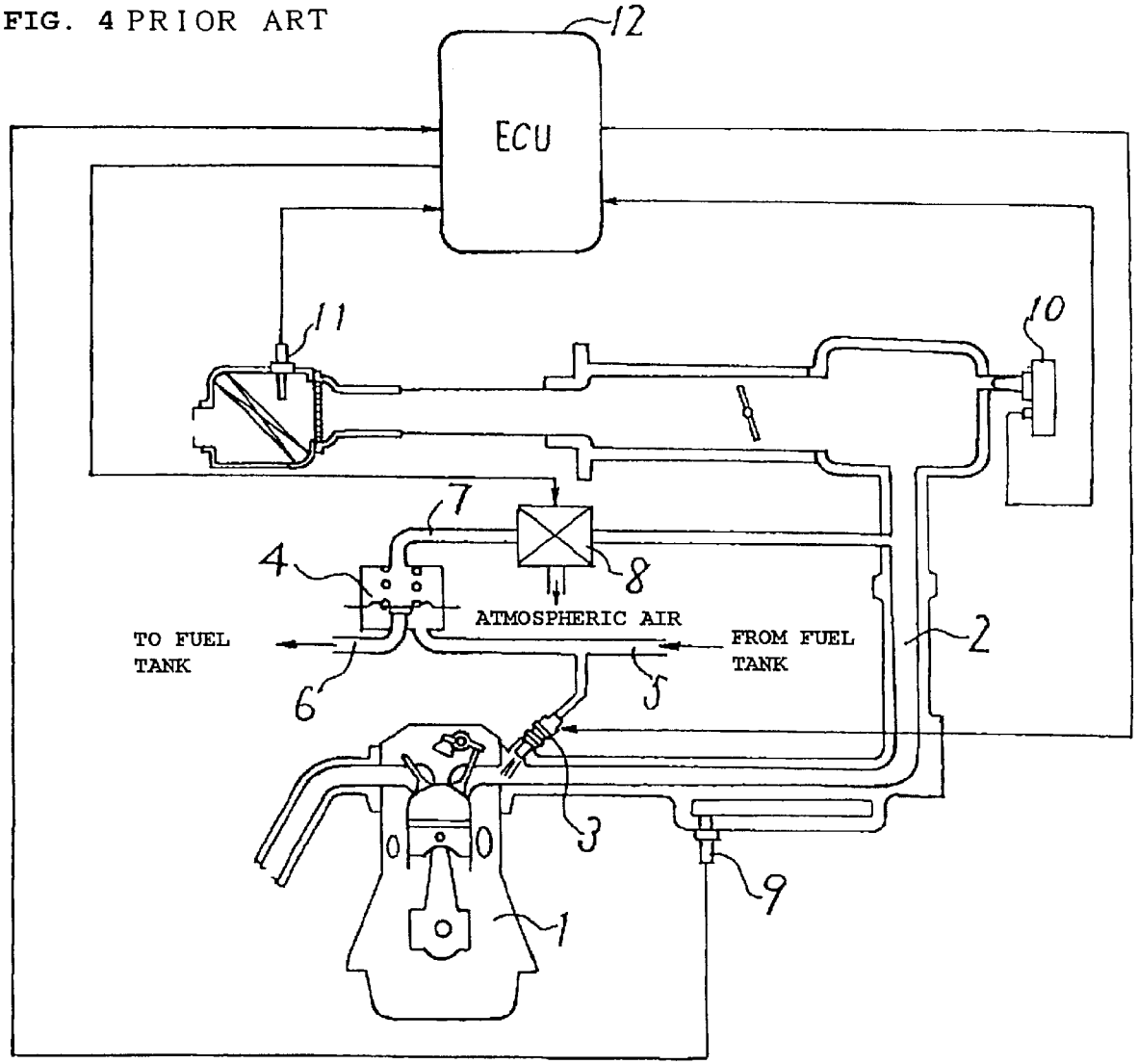
FIG. 4 PRIOR ART
FIG. 4 is a schematic view showing a fuel injection control device according to the prior art.
Figure 5:
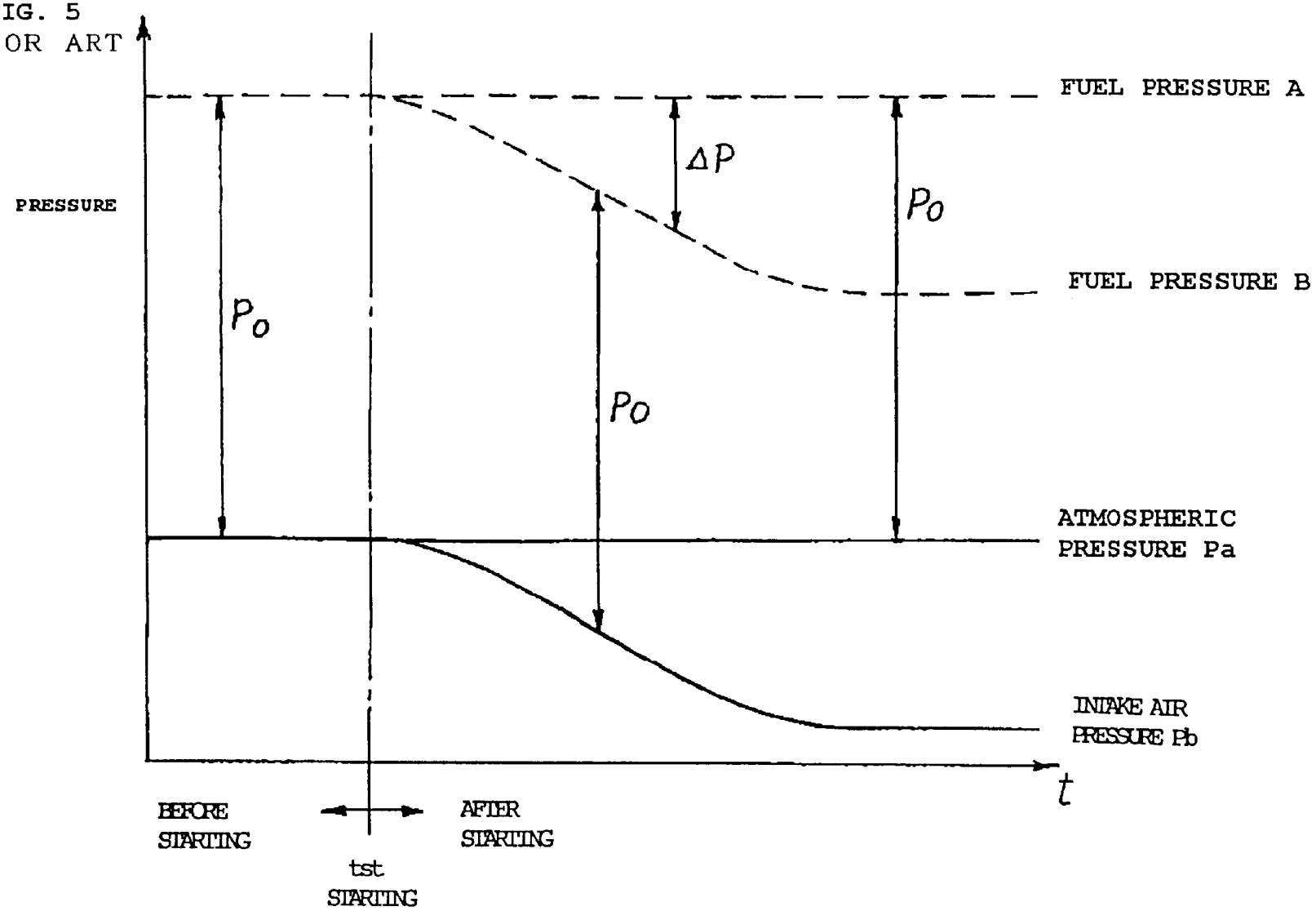
FIG. 5 PRIOR ART
FIG. 5 is a graph explaining the fuel injection control device according to the prior art.
Figure 6:
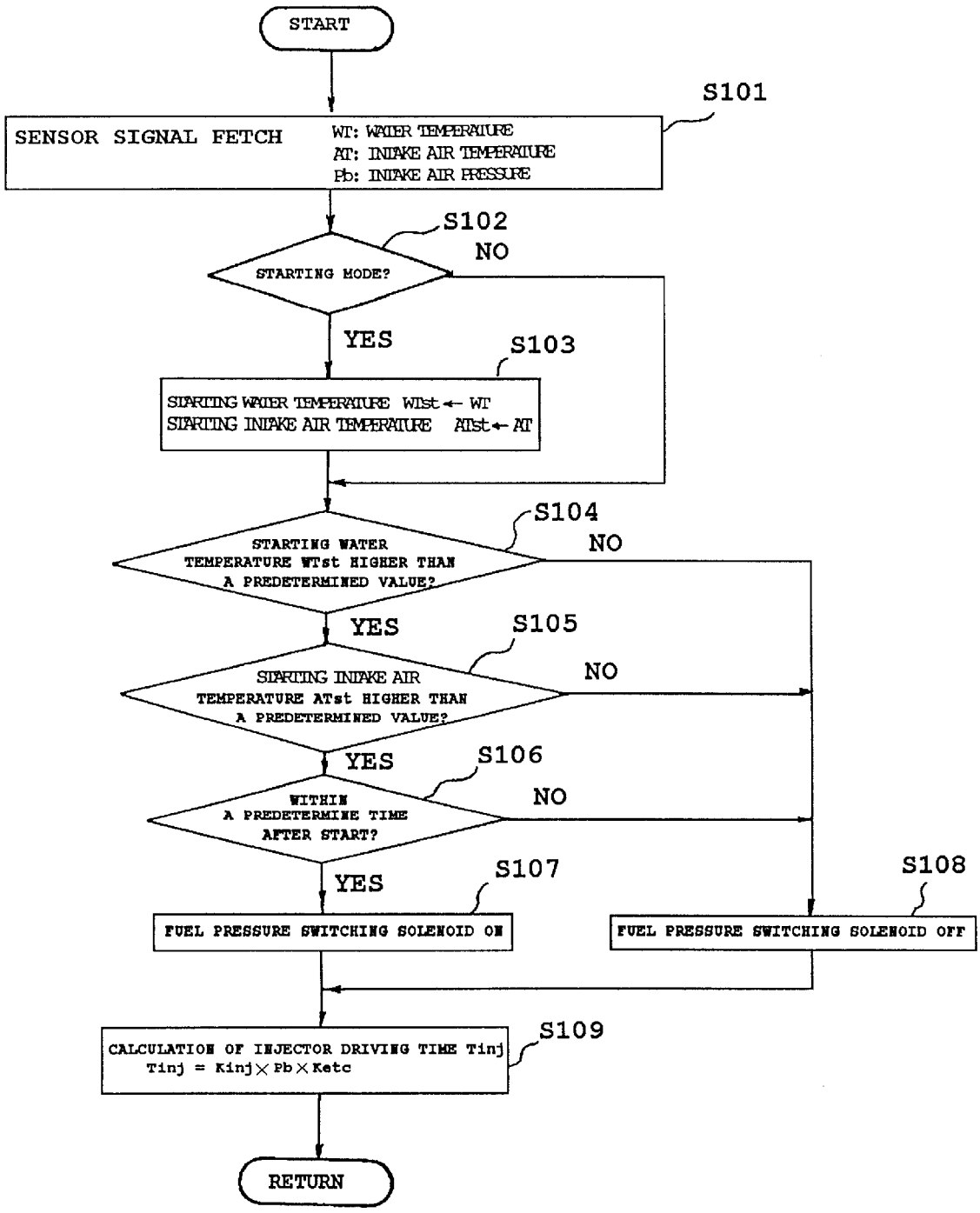
FIG. 6 PRIOR ART
FIG. 6 is a flow chart showing a control method in an ECU of the fuel injection control device according to the prior art.

FIG. 3 is a graph to explain the correction coefficient Khot for starting at a high temperature and shows a relation between the intake air pressure and the correction coefficient Khot for starting at a high temperature, respectively. In the prior art, as described above with reference to FIG. 5, because the intake air pressure Pb becomes lower than the atmospheric pressure Pa and the fuel pressure B becomes also lower in proportion thereto after starting the engine, the pressure regulated by the pressure regulator 4 is changed over from the intake air pressure Pb to the atmospheric pressure Pa, thereby supplying additionally a fuel by the amount of ΔP. The correction coefficient Khot for starting the engine at a high temperature according to the invention performs a function in such additional fuel supply. As shown in FIG. 3, a correction coefficient Khot for starting the engine at a high temperature is preliminarily mapped so as to reduce when the intake air pressure Pb is increased and to be 1 when the intake air pressure Pb is equal to the atmospheric pressure Pa 3. The correction coefficient Khot is stored in the control circuit (ECU12) and used when driving time period of the fuel injection valve 3 is calculated.

On the other hand, so long as the temperature WTst or Atst is lower than the predetermined value and the engine is not restarted within the predetermined time in Steps S4 to S6, temperature of the engine is not high at the time of starting and, therefore, the correction coefficient in starting at a high temperature is 1 (Step S8).

In this manner, upon establishing the correction coefficient in starting at a high temperature Khot, a driving time period of the fuel injection valve 3 is calculated (Step S9).

The driving time period Tinj is obtained from the following expression:

$$Tinj=Kinj\times Pb\times Ketc\times Khot$$

where: Pb is the intake air pressure, Kinj is a coefficient for converting the intake air pressure Pb into the driving time period of the fuel injection valve 3. Ketc is a coefficient corresponding to various conditions (refer to the mentioned prior art). More specifically, this is an expression in which the conventional expression for obtaining the calculated value according to the driving time period under normal driving condition is multiplied by the correction coefficient Khot for starting at a high temperature. This high temperature means that at the temperature the vapors (air bubble) are generated in the delivery pipe 5 of the engine, in the starting condition. In this embodiment, when temperature of the engine 1 is high at the time of starting, the driving time period of the fuel injection valve 3 is set to be longer according to the multiplication by the correction coefficient Khot for starting at a high temperature, thereby the fuel quantity injected to the engine 1 being increased. On the other hand, temperature of the engine 1 is not high temperature at the time of starting, the correction coefficient Khot for starting at a high temperature is 1, and therefore the driving time period remains unchanged as it is.

In this manner, as a result of multiplying by the correction coefficient Khot for starting at a high temperature, the driving time period of the fuel injection valve 3 is made longer, and it is possible to cover the deficiency in fuel quantity due to generation of the vapors at the time of starting the engine 1. Such deficiency coverage can be performed without using any conventional fuel pressure switching solenoid, and therefore an advantage of reducing the cost of fuel injection control device can be achieved.

Moreover, in the invention, since the correction quantity is controllably decided without using the fuel pressure switching solenoid 8, more flexible control can be performed than in the prior art. That is, in the mentioned prior art, by turning on/off the fuel pressure switching solenoid 8, the fuel pressure is increased by ΔP corresponding to the pressure difference regulated by the pressure regulator 4 from the atmospheric pressure Pa to the intake air pressure Pb. Depending on the operating conditions, however, more or less fuel quantity than the pressure difference is actually increased in some cases, and in the prior art there is a problem of not being capable of flexibly adjusting the fuel quantity according to the operating conditions. To solve the problem, in the invention, the correction quantity is controllably decided and increase or decrease in correction coefficient Khot for starting at a high temperature with respect to the intake air pressure Pb is stored in ECU12, taking characteristics of individual engines 1 and driving conditions thereof into consideration. As a result, the fuel injection quantity can be more flexibly established than in the prior art.

What is claimed is:

1. A fuel injection control device comprising:

a fuel injection valve for supplying a fuel into an intake pipe of an internal combustion engine, a water temperature detector for detecting a cooling water temperature of the internal combustion engine, an intake temperature detector for detecting an intake air temperature of the internal combustion engine, a pressure detector for detecting an intake air pressure of the internal combustion engine, means for deciding a driving time period for said fuel injection valve depending on a calculated value calculated from at least the cooling water temperature, the intake air temperature, and the intake air pressure, and means for increasing the driving time period by multiplying the calculated value by a correction coefficient at a high temperature engine starting condition established corresponding to the cooling water temperature, the intake air temperature, and a progress time after starting time of the internal combustion engine, wherein the high temperature engine starting condition is established in the condition that the cooling water temperature and the intake air temperature are higher than predetermined value, and the progress time is shorter than the predetermined value.

2. The fuel injection control device according to claim 1, wherein the correction coefficient is reduced in proportion to the increase in the intake air pressure and the correction coefficient is equal to 1 at the atmospheric pressure.

* * * * *